US005800326A

United States Patent [19]

Meynard et al.

[11] Patent Number: 5,800,326

[45] Date of Patent: Sep. 1, 1998

[54] PROCESS FOR MANUFACTURING A HANDLE FOR A BAG MADE OF PAPER OR ANOTHER MATERIAL

[76] Inventors: Joseph Meynard, 14, rue Octave Mirbeau; Antoine Vidal, Rue Paul Brousse, both of 11100 Narbonne, France

[21] Appl. No.: 619,694

[22] PCT Filed: Sep. 26, 1994

[86] PCT No.: PCT/FR94/01117

§ 371 Date: Jun. 24, 1996

§ 102(e) Date: Jun. 24, 1996

[87] PCT Pub. No.: WO95/09776

PCT Pub. Date: Apr. 13, 1995

[30] Foreign Application Priority Data

Oct. 1, 1993 [FR] France ..... 93 11979

[51] Int. Cl.[6] ..... B65D 33/10

[52] U.S. Cl. ..... 493/226; 493/88; 493/221; 493/231; 493/909; 493/926

[58] Field of Search ..... 493/67, 88, 162, 493/231, 226, 236, 356, 363, 405, 909, 926, 69, 70, 79, 80, 89, 210, 221

[56] References Cited

U.S. PATENT DOCUMENTS

| | | | |
|---|---|---|---|
| 1,897,910 | 2/1933 | Malvern et al. . | |
| 2,089,670 | 8/1937 | Snyder | 229/54 |
| 2,234,180 | 3/1941 | Lackey et al. | 229/54 |
| 3,034,409 | 5/1962 | Finke | 493/926 |
| 3,141,600 | 7/1964 | Rosenthal | 229/55 |
| 3,774,837 | 11/1973 | Franson | 229/54 |
| 3,776,108 | 12/1973 | Nock . | |
| 3,834,528 | 9/1974 | Pickford et al. | 206/526 |
| 3,865,018 | 2/1975 | Gaffney | 93/8 |
| 4,031,815 | 6/1977 | Verbeke | 93/33 |
| 4,221,321 | 9/1980 | Langen et al. | 229/54 |
| 4,528,694 | 7/1985 | Skovgaard | 383/10 |
| 4,655,737 | 4/1987 | Benoit | 493/194 |
| 5,393,293 | 2/1995 | Cilia | 493/926 |

*Primary Examiner*—Joseph J. Hail, III
*Assistant Examiner*—Christopher W. Day
*Attorney, Agent, or Firm*—Adams Law Firm, P.A.

[57] ABSTRACT

The process for manufacturing an integrally-formed handle for a bag includes the steps of turning an edge of a sheet of bag stock on itself a predetermined number of times to form a multiple-thickness handle on the sheet stock, while leaving an adjacent portion of the sheet stock unfolded. The opposed side edge portions of the handle are then folded onto and overlying the unfolded portion of the sheet stock. The folded side edge portions are then glued onto the unfolded portion of the sheet stock. The central portion of the handle is then severed from the unfolded portion of the sheet stock. The unfolded portion of the sheet stock is then folded and glued into a bag enclosure with the handle residing adjacent a side of the bag defining a top opening.

10 Claims, 3 Drawing Sheets

PROCESS FOR MANUFACTURING A HANDLE FOR A BAG MADE OF PAPER OR ANOTHER MATERIAL

This application is a national stage application, according to Chapter II of the Patent Cooperation Treaty. This application claims the priority date Oct. 1,1993 for French Pat. No. 93 11979.

TECHNICAL FIELD AND BACKGROUND OF THE INVENTION

The object of the present invention is a process for manufacturing a handle for lifting and carrying a bag made of paper or other material.

The handles of paper bags are most often mounted on the body of the bag by various fastening processes. This technique is expensive because the part forming the handle is added by fastening during a second manufacturing phase. To eliminate this disadvantage, it was suggested in U.S. Pat. No. 4,221,321 that the handle of a bag be constructed by gluing a reinforcing strip along its edge, then cutting this edge at each side, folding the tabs cut out this way at a right angle and gluing them on the sheet forming the bag, and finally making a rectangular cutting below the middle part, the cut-out part being folded upward against the reinforcing strip.

This precess still entails the drawback of using an additional part, the reinforcing strip in this case, which must be glued close to the edge of the bag before the cutting and gluing operations.

SUMMARY OF THE INVENTION

The invention is based on the idea of constructing the handle of a bag from the single piece forming the latter, thus making it an integral part of the bag.

According to the invention, the handle is formed by folding or winding, as well as cutting and gluing operations carried out directly on the sheet forming the bag without the addition of any supplementary part.

Because of the innovative folding and cutting concept, the process can be carried out on one machine and in a continuous way.

The process according to the invention basically consists of folding or rolling the upper edge of the sheet used to make the bag on itself a certain number of times, making two cutting lines along said rolled or folded edge on both sides of its middle region, folding the side parts cut out from said rolled or folded edge downward at a right angle and gluing them to said sheet, and then making a cut in said middle part immediately below said rolled or folded edge.

According to one preferred embodiment of the invention, the process for manufacturing an integrally-formed handle for a bag includes the steps of turning an edge of a sheet of bag stock on itself a predetermined number of times to form a multiple-thickness handle on the sheet stock, while leaving an adjacent portion of the sheet stock unfolded. The opposed side edge portions of the handle are then folded onto and overlying the unfolded portion of the sheet stock. The folded side edge portions are then glued onto the unfolded portion of the sheet stock. The central portion of the handle is then severed from the unfolded portion of the sheet stock. The unfolded portion of the sheet stock is then folded and glued into a bag enclosure with the handle residing adjacent a side of the bag defining a top opening.

According to another preferred embodiment of the invention, the process includes the step of severing the opposed side edge portions of the handle from the unfolded portion of the sheet stock before the side edge portions are folded onto the unfolded portion of the sheet stock.

According to another preferred embodiment of the invention, the step of turning the sheet stock on itself includes the step of folding the sheet stock.

According to yet another preferred embodiment of the invention, the step of turning the sheet stock on itself includes the step of rolling the sheet stock.

According to yet another preferred embodiment of the invention, the step of folding the side edge portions of the handle onto and overlying the unfolded portion of the sheet stock includes the step of folding the side edge portions at a right angle onto the unfolded portion of the sheet stock.

According to yet another preferred embodiment of the invention, the step of folding the side edge portions of the handle onto and overlying the unfolded portion of the sheet stock includes the steps of first severing the side edge portions from the unfolded portion of the sheet stock, and then folding the severed side edge portions onto the unfolded portion of the sheet stock at a right angle to the central portion of the handle.

According to yet another preferred embodiment of the invention, the sheet stock is paper or plastic film.

According to another preferred embodiment of the invention, the process includes the steps of turning an edge of a sheet of bag stock on itself a predetermined number of times to form a multiple-thickness handle on the sheet stock, while leaving an adjacent portion of the sheet stock unfolded. Two pairs of attachment portions of the handle are then severed from the unfolded portion of the sheet stock, while leaving first and second central portions of the handle separated by two of the attachment portions of the handle connected to the unfolded portion of the sheet stock. The severed pairs of attachment portions of the handle are then folded onto and overlying the adjacent unfolded portion of the sheet stock. The folded attachment portions of the handle are then glued onto the unfolded portion of the sheet stock. The first and second central portions of the handle are then severed from the unfolded portion of the sheet stock. The unfolded portion of the sheet stock is then folded and glued into a bag enclosure having a pair of handles positioned on opposite sides of the bag enclosure defining a top opening in registration with each other for being grasped together.

BRIEF DESCRIPTION OF THE DRAWINGS

The attached drawing is provided to illustrate but in no way to limit the scope of the invention.

DESCRIPTION OF THE PREFERRED EMBODIMENTS AND BEST MODE

Figure 1A:
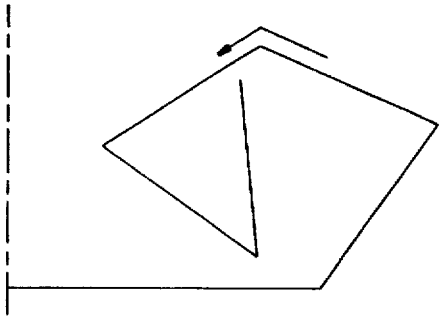
FIGS. 1*a–b* and 2*a–b* show that the strength of the handle is a function of the more or less high number of folds or windings carried out.
Figure 1B:
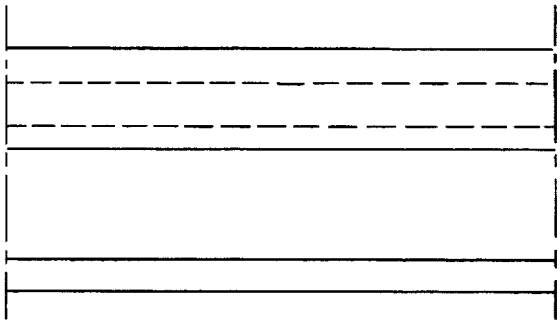
Figure 2A:
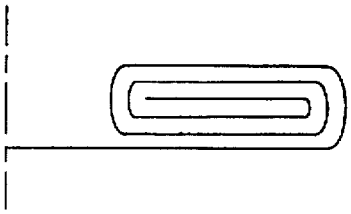
Figure 2B:
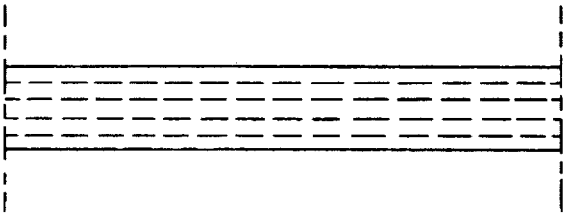

Referring now specifically to the drawings, a process for manufacturing an integrally-formed handle for a bag is illustrated and described below. As shown in FIG. 1, a sheet of bag stock is first folded at its top edge a predetermined number of times to form a multiple-thickness handle on the sheet stock, while leaving an adjacent portion of the sheet stock unfolded. Alternatively, the top edge of the bag stock is rolled as shown in FIG. 2.

Figure 3A:
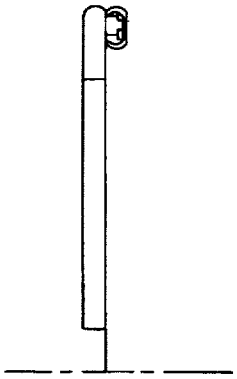
FIGS. 3*a–b* show the rolled edge cut to the desired dimension on the left and right sides and the lateral parts folded at a right angle and glued to the body of the bag.
Figure 3B:
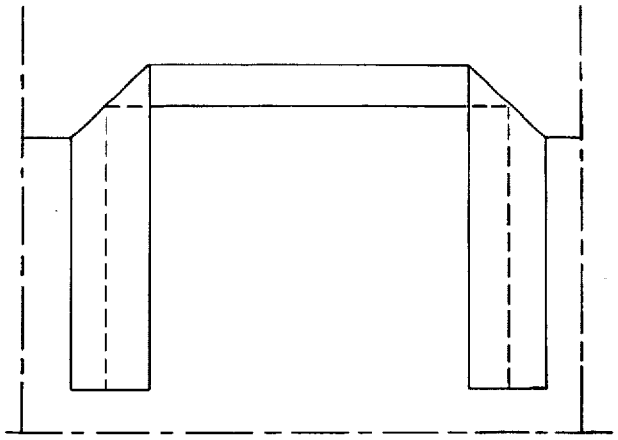

Next, according to the technique illustrated in FIG. 3, the opposing side edge portions of the handle are cut from the unfolded portion of the sheet stock, and are then folded downwardly at an angle perpendicular to the folded or rolled edge of the sheet stock. The cut side edge portions are then glued onto the unfolded portion of the sheet stock, and the unfolded portion cut adjacent the folded or rolled portion to complete the formation of the handle. The unfolded portion of the sheet stock is subsequently folded and glued into a bag enclosure (not shown) with the multiple-thickness handle residing adjacent a side of the bag defining a top opening.

Figure 4:
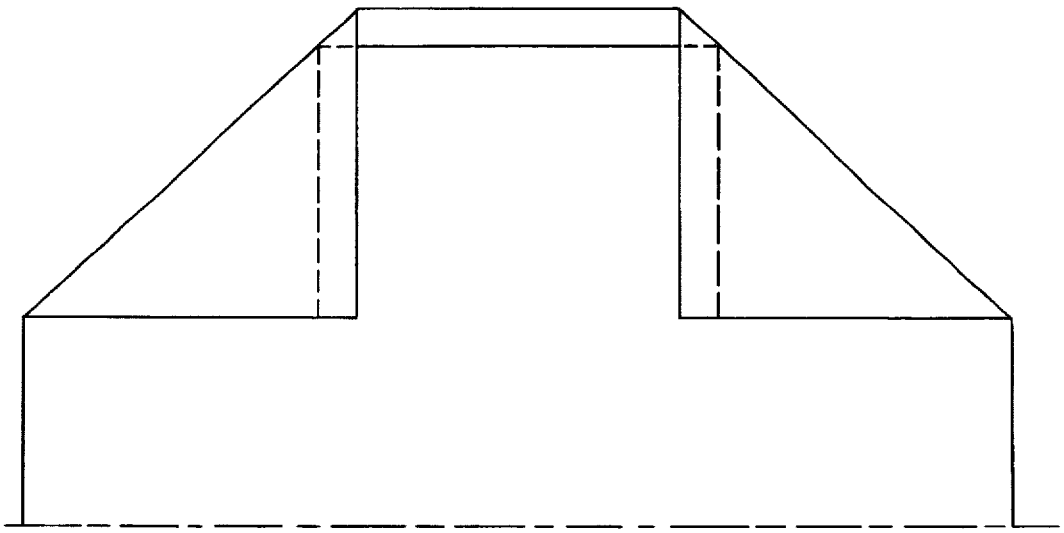
FIG. 4 shows another embodiment without cutting in which the left and right parts are folded perpendicularly with respect to the part of the rolled edge remaining in its initial position and giving an advance outline of the handle.

According to a second technique shown in FIG. 4, the side edge portions of the handle are not cut as in FIG. 3, but are folded inwardly at an angle perpendicular to the folded or rolled portion, and then glued to the unfolded portion of the sheet stock. The unfolded portion of the sheet stock is then cut adjacent the folded or rolled portion to complete the formation of the handle.

Figure 5:
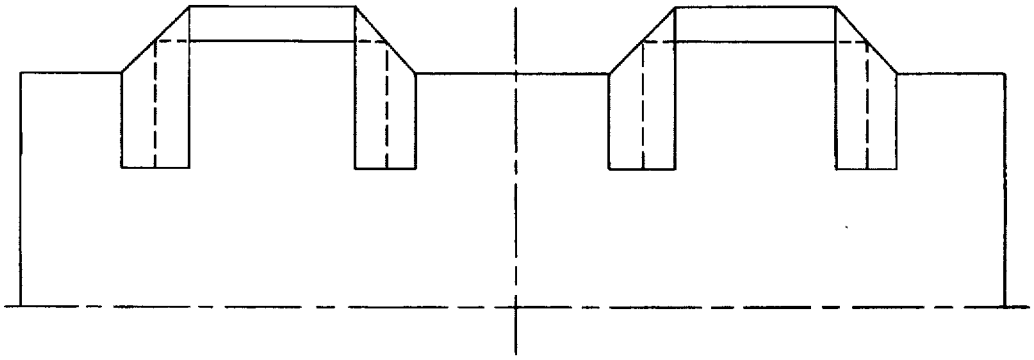
FIG. 5 and 6 illustrate variations that allow construction of a bag with two handles in the same sheet.

According to a third technique shown in FIG. 5, the sheet stock is folded or rolled at its top edge and cut to form two separate multiple-thickness handles. After first folding or rolling the top edge, a pair of side edge portions for each handle are cut and then folded downwardly at an angle perpendicular to the folded or rolled portion of the sheet stock. The pairs of side edge portions are then glued to the unfolded portion of the sheet stock, and the sheet stock cut adjacent the folded or rolled portions to complete the formation of the two handles.

Figure 6:
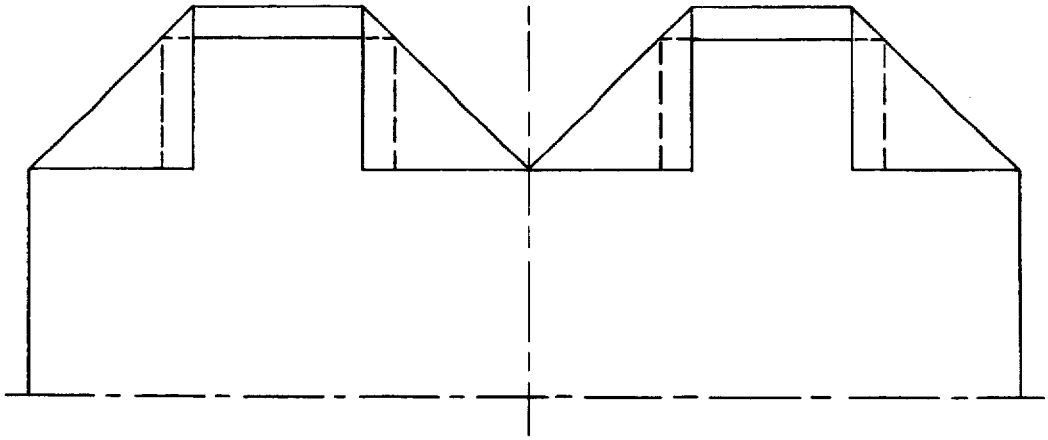

According to a fourth technique shown in FIG. 6, the sheet stock is folded or rolled at its top edge, and then cut and further folded to form two separate multiple-thickness handles. After first folding or rolling the top edge, the sheet stock is cut vertically at a center point of its top edge. A pair of side edge portions for each handle are then folded inwardly at an angle perpendicular to the folded or rolled portion of the sheet stock. The pairs of side edge portions are then glued to the unfolded portion of the sheet stock, and the sheet stock cut adjacent the folded or rolled portions to complete the formation of the two handles.

A process for manufacturing an integrally-formed handle for a bag is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method for manufacturing an integrally-formed handle of a bag, comprising the steps of:

(a) turning an edge of a sheet of bag stock on itself a plurality of times about a longitudinal handle axis to from a multiple-thickness handle on the sheet stock, while leaving an adjacent portion of the sheet stock unfolded;

(b) folding opposed multiple-thickness side edge portions of the multiple-thickness handle onto and overlying the unfolded portion of the sheet stock so as to define respective folded sides of the handle;

(c) gluing the folded side edge portions of the handle onto the unfolded portion of the sheet stock; and (d) severing the unfolded portion of the sheet stock along a line adjacent the handle to complete formation of the handle.

2. A method for manufacturing a bag handle according to claim 1, and including the step of severing said opposed side edge portions of the handle from the unfolded portion of the sheet stock before the side edge portions are folded onto the unfolded portion of the sheet stock.

3. A method for manufacturing a bag handle according to claim 1, wherein the step of turning the sheet stock on itself comprises folding the sheet stock at a plurality of fold lines.

4. A method for manufacturing a bag handle according to claim 1, wherein the step of turning the sheet stock on itself comprises rolling the sheet stock a plurality of times without forming fold lines.

5. A method for manufacturing a bag handle according to claim 1, wherein the step of folding the side edge portions of the handle onto and overlying the unfolded portion of the sheet stock includes the step of folding the side edge portions onto the unfolded portion of the sheet stock at a right angle relative to an end edge portion of the sheet stock.

6. A method for manufacturing a bag handle according to claim 1, wherein the step of folding the side edge portions of the handle onto and overlying the unfolded portion of the sheet stock comprises the steps of first severing the side edge portions from the unfolded portion of the sheet stock and then folding the severed side edge portions onto the unfolded portion of the sheet stock at a right angle to the central portion of the handle.

7. A method for manufacturing an integrally-formed handle of a hag, comprising the steps of:

(a) turning an edge of a sheet of bag stock on itself a plurality of times about a longitudinal handle as to form a multiple-thickness handle on the sheet stock, while leaving an adjacent portion of the sheet stock unfolded;

(b) severing two pairs of multiple-thickness attachment portions of the handle from the unfolded portion of the sheet stock, while leaving first and second multiple-thickness central portions of the handle separated by two of the attachment portions of the handle connected to the unfolded portion of the sheet stock;

(c) folding the severed pairs of multiple-thickness attachment portions of the handle onto and overlying the adjacent unfolded portion of the sheet stock so as to define respective folded sides of the handle;

(d) gluing the folded attachment portions of the handle onto the unfolded portion of the sheet stock; and (e) severing the first and second central portions of the handle from the unfolded portion of the sheet stock.

8. A method for manufacturing a bag handle according to claim 7, wherein the step of turning the sheet stock on itself comprises folding the sheet stock at a plurality of fold lines.

9. A method for manufacturing a bag handle according to claim 7, wherein the step of turning the sheet stock on itself comprises rolling the sheet stock a plurality of times without forming fold lines.

10. A method for manufacturing a bag handle according to claim 7, wherein the step of folding the severed side edge portions of the handle onto and overlying the unfolded portion of the sheet stock comprises folding the severed side edge portions at a right angle to the central portion of the handle.

* * * * *